US005632047A

United States Patent [19]

Van Den Heuvel

[11] Patent Number: 5,632,047

[45] Date of Patent: May 27, 1997

[54] CAP ATTACHMENT

[76] Inventor: Ernest A. Van Den Heuvel, 4 S. Ridge Rd., Pomona, N.Y. 10970

[21] Appl. No.: 494,323

[22] Filed: Jun. 23, 1995

[51] Int. Cl.[6] ..... A42B 1/24

[52] U.S. Cl. ..... 2/209.13; 2/171.4; 2/181.4; 2/195.2; 40/329; 63/20

[58] Field of Search ..... 2/171.4, 171.5, 2/181, 181.2, 181.4, 209.13, 244, 195.2, 195.3, 195.4; 40/329, 586, 611, 617, 620, 622, 640; 63/20

[56] References Cited

U.S. PATENT DOCUMENTS

| | | | |
|---|---|---|---|
| 2,276,592 | 3/1942 | Reitman | 63/20 |
| 2,796,680 | 6/1957 | Wittcoff . | |
| 4,333,180 | 6/1982 | Bay . | |
| 4,776,043 | 10/1988 | Coleman . | |
| 4,872,218 | 10/1989 | Holt | 2/171.5 |
| 4,873,726 | 10/1989 | Tapia . | |
| 4,985,935 | 1/1991 | Hur . | |
| 5,003,640 | 4/1991 | Pizzacar . | |
| 5,253,368 | 10/1993 | Blake . | |
| 5,282,278 | 2/1994 | Miner . | |
| 5,287,559 | 2/1994 | Christiansen et al. | 2/181 |
| 5,359,733 | 11/1994 | Brannon et al. . | |
| 5,359,734 | 11/1994 | Rathburn . | |
| 5,373,586 | 12/1994 | Brosnan . | |
| 5,418,981 | 5/1995 | Miner | 2/209.13 |
| 5,454,120 | 10/1995 | Rowlands | 40/329 |
| 5,499,402 | 3/1996 | Rose | 2/181.4 |

*Primary Examiner*—Diana Biefeld
*Attorney, Agent, or Firm*—Friscia & Nussbaum

[57] ABSTRACT

An attachment useful for a conventional type sports cap which has a fabric dome, a headband surrounding the dome, a pair of straps at the rear of the cap for adjustment of the size of the headband and an opening in the dome of the cap above the straps. The attachment has a planar member having a first surface, a second surface, a top area and an opposite bottom area. An indicia means is provided on the first surface for displaying a trademark and/or logo. At least one fastening means is provided on the top area of the second surface for removably fastening the attachment means to the fabric of the cap. There is at least one fastening member on the bottom area of the second surface for removably fastening the attachment to the strap of the cap. Preferably the fastening member is a hook member which hooks onto the straps. The planar member is of a size, and the fastening means and the fastening member are arranged on the second surface in such a manner, that when the fastening member is fastened to the straps and the fastening means is fastened to the fabric surrounding the opening, the attachment substantially covers the opening and the indicia means displays the trademark and/or logo.

10 Claims, 3 Drawing Sheets

CAP ATTACHMENT

SPECIFICATION

1 Field of the Invention

This application relates to an attachment for a cap or hat for displaying trademarks and logos, and in particular an attachment that can be removably attached to the rear of the cap.

2 Background of the Invention

Caps and other head wear, in particular, casual baseball style sporting caps that are easily adjustable, and useful for protecting the wearers eyes from sunlight or rain, have become very popular in recent years. Such caps are generally made of fabric or woven material having a hemispherical crown or dome. The crown may also be cylindrical with a flat top. Typically, inside the dome, at the lower periphery, is a reinforced headband terminating at the rear of the dome with adjustable straps for securing the cap to the head. An opening in the dome is provided above such adjustable straps. At the forward lower periphery portion of the stiff visor or bill to help keep the sun out of the eyes of the wearer. Typically, on the outside forward portion of the dome, indicia, e.g., a trademark or logo, is placed.

Most of such caps are decorated on the front portion of the dome with screen printed or embroidered indicia, such as team names, logos, trademarks, characters, special events, etc. Recently it has become fashionable to wear such caps with the visor directed rearwardly. Wearing the cap in this orientation deemphasizes the indicia, e.g. trademark and/or logo usually displayed on the front portion of the dome of the cap. Such deemphasis of a merchant's or team's trademark and/or logo is undesirable and does not maximize the potential goodwill that can be developed from the display of the indicia. Further, when the cap is worn in such a fashion the opening in the dome can cause an an uneven and possibly unsightly sunburn on the forehead of the wearer. There is thus a need for an indicia, e.g., logo/trademark bearing cap attachment that can be secured to the rear of the cap to permit the display of the indicia near the face of the wearer of the cap and to cover up the opening in the rear of the dome.

There are numerous devices relating to means for displaying trademarks and logos on caps. Many of these devices are removable and have a various means for attachment.

Reference is made to the following U.S. Patents:

2,796,680 to E. Wittcoff 4,333,180 to Bay 4,776,043 to Coleman 4,873,726 to Tapia 4,985,935 to Hur 5,003,640 to Pizzacar 5,253,368 to Blake 5,282,278 to Miner 5,359,733 to Brannon et al.

5,359,734 to Rathburn 5,373,586 to Brosnan

U.S. Pat. No. 2,796,680 to E. Wittcoff describes a hat adapted for various types of educational drills and games in which a series of problems or questions are imprinted along the outside face to the hatband and the correct answers can be ascertained from the inside face of the hatband though an aperture or window in the crown.

U.S. Pat. No. 4,333,180 to Bay describes a visor attached to a helmet by snaps.

U.S. Pat. No. 4,776,043 to Coleman describes a hat with interchangeable patches that can be selectively attached to the hat. An incomplete phrase or logo is printed on the front surface and a strip of fastening material or adhesive secured to the hat just below the incomplete phrase. A plurality of separate patches is provided, each printed with a different completion to the hat's printed phrase or logo, and each with a back surface that is attachable to the fastening material on the hat. Thus, the user can select the completion of the phrase with the patch of his choice.

U.S. Pat. No. 4,873,726 to Tapia describes an adjustable baseball type cap assemblage having a crown portion and various interchangeable visor portions. Insignia patches of various styles can be removably affixed to the selected visor and crown portions so that one cap assembly can be modified to identify with several athletic teams.

U.S. Pat. No. 4,985,935 to Hur describes a cap visor which includes a lower visor, a foldable upper visor, and a pop-up display located between the lower and foldable upper visor.

U.S. Pat. No. 5,003,640 to Pizzacar describes a cap having a removable advertising cap nameplate for concealing the pair of adjustable straps at the rear of the cap.

U.S. Pat. No. 5,253,368 to Blake describes a cap having a writing surface and a writing implement attached to the crown of the cap.

U.S. Pat. No. 5,282,278 to Miner describes a cap attachment which folds about and captures the rear straps of a baseball style cap. The attachment allows for the display of emblems or other indicia thereon.

U.S. Pat. No. 5,359,733 to Brannon et al. describes a hat which can simultaneously accept a plurality of patches. The patches are connected to the hat by hook and loop fasteners. The cap has an area of hook material either integrally formed with the cap or retrofitted to a pre-existing six-panel cap.

U.S. Pat. No. 5,359,734 to Rathburn describes a hat having an opening therein. One element of a hook-and-pile type fastening means is sewed in the opening. A number of cloth panels are provided, each of substantially the same size as the opening and bearing a name, logo, character, or other message on one side thereof. Each of the cloth panels has the other part of the two-part fastening means secured on its other side so that it may be attached to the hat when its particular name, logo, or other message has been selected for display with the hat.

U.S. Pat. No. 5,373,586 to Brosnan describes a sports cap and a replaceable pie-shaped panel made of one or more pie-shaped portions of fabric. The replaceable pie-shaped panel is detachably connected to the hat so as to be completely removable from the sports cap.

OBJECTS AND SUMMARY OF INVENTION

It is an object of this invention to provide a removable attachment means for a cap.

It is a further object of this invention to provide a removable attachment which can be easily and securely attached to the rear of the cap.

A further object of this invention to provide an attachment means with has sufficient area to display a large trademark or logo and simultaneously cover the opening in the rear portion of the dome of the cap.

A further object of this invention is to provide an attachment means which covers the unsightly adjusting-straps in the rear of a cap.

Another object of this invention is to provide an improved sports cap having a capability to vary the information displayed on the cap, such as trademarks and/or logos.

It is further object of this invention to provide an attachment to a sports cap which is designed to cover the adjustable straps in the back of the sports cap and the opening in the dome of the cap which is above the adjustable straps.

The present invention allows an individual to purchase one cap and display several different trademarks and/or logos on different occasions by simply changing the attachment bearing one trademark and/or logo and replacing it with another attachment for a different trademark and/or logo, saving the cost related to purchasing individual caps. The attachments can be purchase, at the same time with the cap or can be purchased separately, the cost of each attachment being substantially less of than the price of a new sports cap.

All of the foregoing objects of this invention are obtained with the attachment of this invention. The attachment is particularly useful for a conventional type sports cap which has a fabric dome, a headband surrounding the dome, a pair of straps at the rear of the cap for adjustment of the size of the headband and an opening in the dome of the cap above the straps.

The attachment comprises a planar member having a first surface, a second surface, a top area and an opposite bottom area. An indicia means is provided on the first surface for displaying a trademark and/or logo. At least one fastening means is provided on the top area of the second surface for removably fastening the attachment means to the fabric of the cap. Preferably, there is at least one fastening member on the bottom area of the second surface for removably fastening the attachment to the strap of the cap. Preferably the fastening member is a hook member which hooks onto the straps.

The planar member is of a size, and the fastening means and the fastening member are arranged on the second surface in such a manner, that when the fastening member is fastened to the straps and the fastening means is fastened to the fabric surrounding the opening, the attachment substantially covers the opening and the indicia means displays the trademark and/or logo.

BRIEF DESCRIPTION OF THE DRAWINGS

The novel features which are considered characteristic for the invention are set forth in the appended claims. The invention itself, however, both as to construction and its method of operation, together with additional objects and advantages thereof, will be best understood from the following description of the specific embodiments when read in connection with the accompanying drawing.

DETAILED DESCRIPTION OF THE INVENTION

Figure 1:
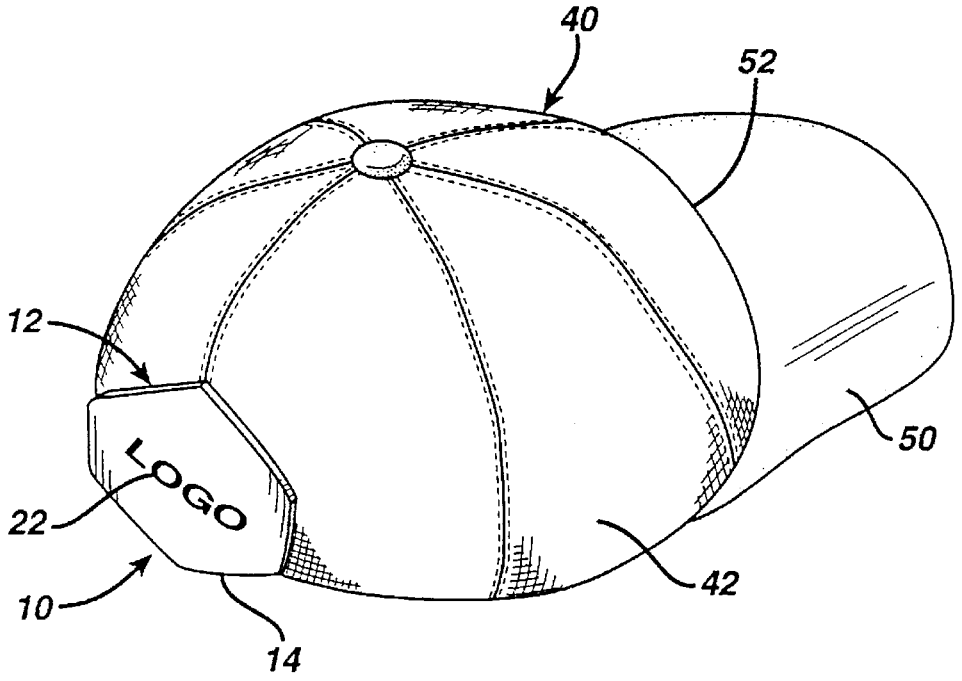
FIG. 1 is a perspective view of an embodiment of the attachment of this invention attached to a cap.

Referring to the Figures, and in particular FIGS. 1–4, the attachment 10 is preferably designed for application to the rear of a conventional cap 40 having conventional adjustable straps 46 at the rear of the cap. The cap 40 is a standard, adjustable, billed baseball-style cap made of fabric, plastic or other appropriate material. Cap 40 includes a brim or bill 50 which serves as a shade or a visor for the wearer, and a-fabric dome 42. The dome 42 includes a front wall portion or brow 52 with a rear opening 48 having at the bottom of the opening 48 a pair of adjustable fastening straps 46. The opening 48 may be round, elliptical or some other selected shape. The border of the opening 48 is secured by a seam 54. The pair of adjustable fastening straps 46 extend from the rear of the cap 40 to provide a means for adjusting the size of the cap 40.

The attachment 10 of this invention comprises a planar member 12 which has a first surface 14 and a second surface 16. The planar member 12 has on the first surface 14 an indicia means 22. The indicia means 22 can be a trademark and/or logo of a team, character name, product display or a statement that the wearer of the cap 40 desires to show to the public.

Figure 2:
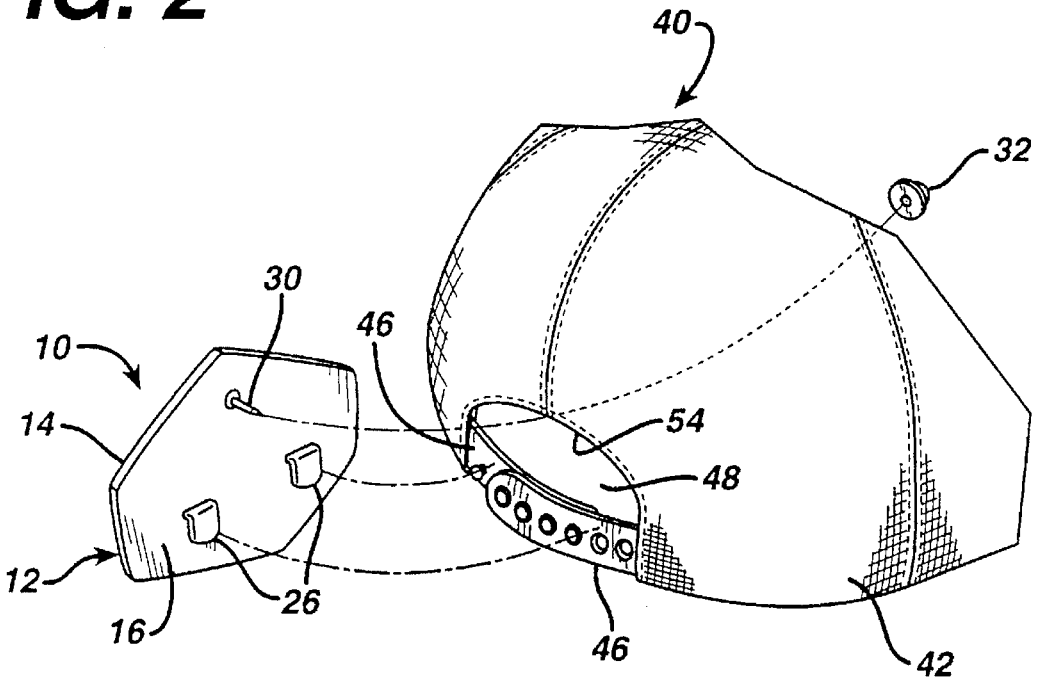
FIG. 2 is an exploded perspective view of the attachment of FIG. 1 prior to attachment to the cap.
Figure 3:
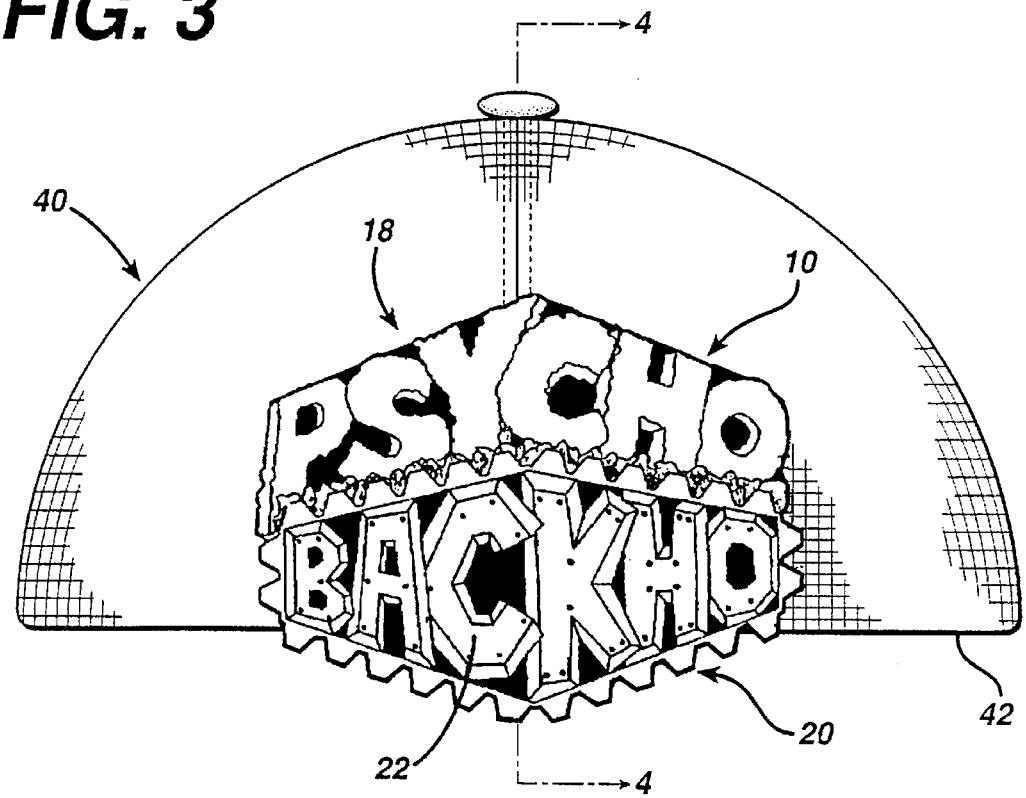
FIG. 3 is view of the back of the cap showing the attachment mounted to the cap.
Figure 4:
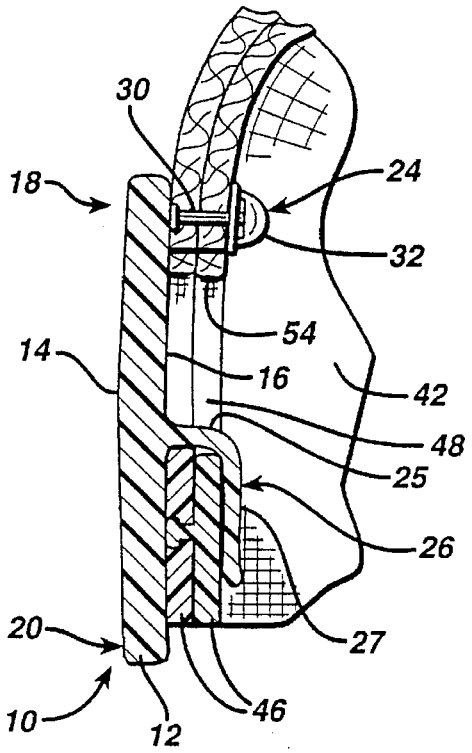
FIG. 4 is a cross sectional view of the cap of FIG. 3, taken along line 4—4 of FIG. 3.

Referring to FIGS. 2 and 4, attached to the top area 18 of the second surface 16 is a fastening means 24. This fastening means 24 is designed for removably fastening the attachment 10 to the fabric of the dome 42. This fastening means 24 can be a pin 30 which is placed through the fabric of the dome 42 either by piercing the fabric or placing it through a prefabicated opening. The pin 30 has a removable safety cap 32 thereon.

Figure 5:
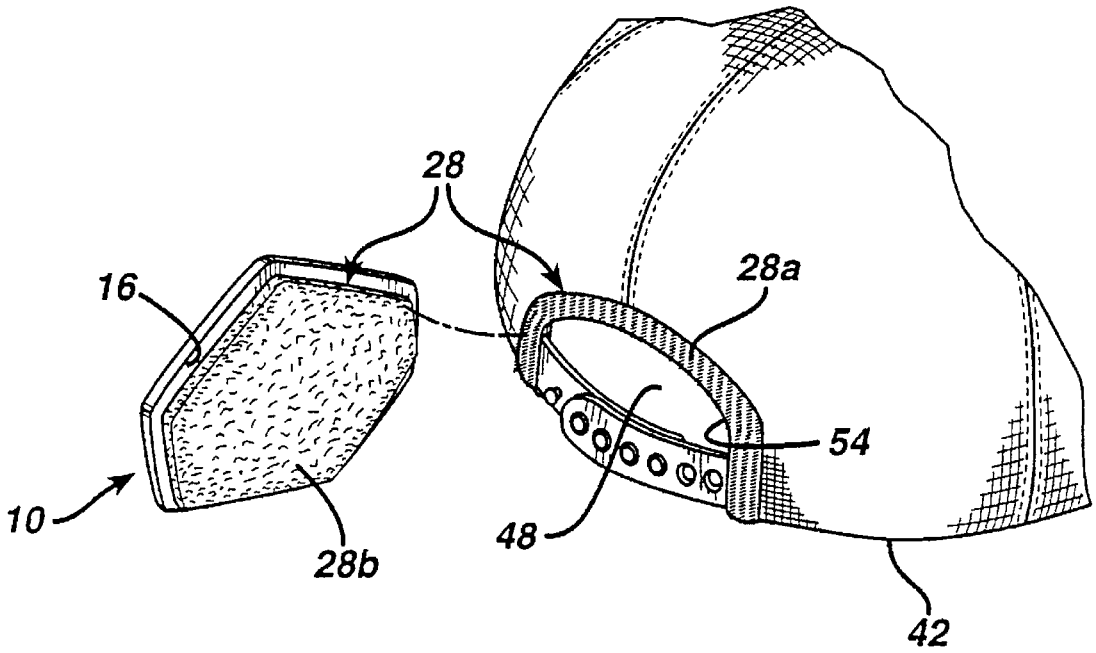
FIG. 5 is an exploded perspective view of another embodiment of the attachment prior to attachment to the cap.

In another embodiment, depicted in FIG. 5, the fastening means may be a hook and loop fastener system 28 (i.e., VELCRO) with one element of the system 28*a* surrounding the opening 48 in the dome 42 at the seam 54 and the other element 28*b* on the second surface 16 of the attachment 10. If desired, this embodiment of the attachment 10 may have a fastening member similar to element 26 depicted in FIGS. 2 and 4 if desired.

Referring to FIGS. 2 and 4, the attachment 10 has a fastening member, preferably a hook member 26, on the bottom area 20 of the second surface 16. The hook member 26 comprises a base 25 and a finger 27. The base 25 has first and second ends, and extends outwardly from the bottom area 20 of the second surface 16 of the attachment 10 and is interconnected at a first end with attachment 10. The finger 27 extends from the second end of the base 25 towards a bottom edge of the attachment 10 and parallel to the second surface 16. This hook member 26 is designed to removably hook onto the adjustable attachment straps 46. The hook member 26 is preferably a plurality of hooks 26, each of which hooks onto a strap 46.

Still referring to FIGS. 2 and 4, in order to attach the attachment 10 to the cap 40, the safety cap 32 of pin 30 is removed, the pin 30 passed through the fabric 42 of the dome 40 and the safety cap 32 placed on the pin 30. Simultaneously the hook member 26 is placed on the straps 46 to support the attachment 10.

The planar member 12 is of a size and shape, and the fastening means 24 and hook member 26 are arranged on the second surface 16 in such a manner, that when the hook member 26 hooks to the straps and the fastening means 24 fastens to the fabric 42 surrounding the opening 48, the attachment substantially covers the opening 40 and the indicia means 22 displays the trademark and/or logo.

The attachment 10 thus provides an indicia on the rear of the cap 40 which is securely attached to the cap 40 and covers the opening 48 in the dome 42. Thus when the cap 40 is worn with the bill 50 facing rearward the indicia 22 can be seen by people facing the person wearing the cap and the forehead of the person is protected from the sun.

The invention illustrated and described herein, is not intended to be limited to the details shown, since it will be understood that various omissions, modifications, substitutions and changes in the forms and details of the device illustrated and its operation can be made by those skilled in the art without departing from the spirit of the present invention.

What is claimed is:

1. A combination cap and attachment for the cap comprising:

a cap having a fabric dome;

a headband surrounding the dome;

a pair of straps at the back of the cap for a adjustment of the size of the headband;

an opening in the dome above the straps;

an attachment removably attached to the cap comprising:

a planar member having a first surface, a second surface, a top area and an opposite bottom area; and indicia means on the first surface for displaying a trademark or logo;

at least one pin means on the top area of the second surface for removably pinning the attachment to the fabric of the dome; and at least one hook member on the bottom area of the second surface for removably hooking the attachment to the straps;

the planar member is of a size, and the pin means and hook member are arranged on the second surface so that when the hook member is hooked to the straps and the pin means is pinned to the fabric surrounding the opening, the attachment substantially covers the opening in the dome and the indicia means displays the trademark or logo.

2. A combination cap and attachment for a cap comprising:

a cap having a fabric dome;

a headband surrounding the dome;

a pair of straps at the back of the cap for adjustment of the headband;

an opening in the dome above the straps;

an attachment removably attached to the cap comprising:

a planar member having a first surface, a second surface, a top area and an opposite bottom area;

indicia means on the first surface for displaying a trademark or logo;

at least one hook member on the bottom area of the second surface for removably fastening the attachment to the straps, the at least one hook member including:

a base having first and second ends, the base extending outwardly from the bottom area of the second surface of the attachment and interconnected at a first end with said attachment;

a finger extending from the second end of the base towards a bottom edge of the attachment, the finger extending parallel to the planar member;

whereby, the at least one hook engages the straps of the cap to attach the attachment to the cap, the indicia means displaying the trademark or logo.

3. A combination cap and attachment for a cap comprising:

a cap having a fabric dome;

a headband surrounding the dome;

a pair of straps at the back of the cap for adjustment of the headband;

an opening in the dome above the straps;

an attachment removably attached to the cap comprising:

a planar member having a first surface, a second surface, a top area and an opposite bottom area;

indicia means on the first surface for displaying a trademark or logo;

at least one fastening means on the top area of the second surface for removably fastening the attachment to the fabric of the dome; and at least one fastening member on the bottom of area of the second surface for removably fastening the attachment to the straps;

the planar member is of a size, and the fastening means and fastening member are arranged on the second surface so that when the attachment is fastened to the straps and the fastening means is fastened to the fabric of the dome, the attachment substantially covers the opening in the dome and the indicia means displays the trademark or logo.

4. The combination cap and attachment of claim 3 wherein the fastening member is a hook member for hooking onto the straps.

5. An attachment for a cap having a dome, a headband surrounding the dome, a pair of straps at the back of the cap for adjustment of the headband, and an opening in the dome above the straps, the attachment comprising:

a planar member having a first surface, a second surface, a top area and an opposite bottom area;

indicia means on the first surface for displaying a trademark or logo;

at least one hook member on the bottom area of the second surface for removably fastening the attachment to a cap, the at least one hook member including:

a base having first and second ends, the base extending outwardly from the bottom area of the second surface of the attachment and interconnected at a first end with said attachment; and a finger extending from the second end of the base towards a bottom edge of the attachment, the finger extending parallel to the planar member;

the at least one hook member is arranged on the second surface so that when the hook member is positioned on a strap of a cap, the attachment is supported by the hook member on a cap and the indicia means displays the trademark or logo.

6. An attachment for a cap having a dome, a headband surrounding the dome, a pair of straps at the back of the cap for adjustment of the headband, and an opening in the dome above the straps, the attachment comprising:

a planar member having a first surface, a second surface, a top area and an opposite bottom area;

indicia means on the first surface for displaying a trademark or logo;

at least one fastening means on the top area of the second surface for removably fastening the attachment to a dome of a cap;

at least one hook member on the bottom area of the second surface for removably fastening the attachment to a cap, the hook member including a base having first and second ends, the base extending outwardly from the bottom area of the second surface of the attachment and interconnected at a first end with said attachment, and a finger extending from the second end of the base towards a bottom edge of the attachment, the finger extending parallel to the planar member;

the planar member is of a size, and the fastening means and fastening member are arranged on the second surface so that when the attachment is fastened to straps of a cap and the fastening means is fastened to a dome of a cap, the attachment substantially covers an opening in a dome of a cap and the indicia means displays the trademark or logo.

7. The attachment of claim 6 wherein the at least one fastening means comprises either hooks or loops a hook and loop fastener system.

8. An attachment for a cap, the cap having a dome, a headband surrounding the dome, a pair of straps at the back of the cap for adjustment of the headband, and an opening in the dome above the straps, the attachment comprising:

a planar member having a first surface, a second surface, a top area and an opposite bottom area;

indicia means on the first surface for displaying a trademark or logo;

at least one pin means on the top area of the second surface for removably pinning the attachment to a dome of a cap; and at least one hook member on the bottom area of the second surface for removably hooking the attachment to straps of a cap, the hook member including:

a base having first and second ends, the base extending outwardly from the bottom area of the second surface of the attachment and interconnected at a first end with said attachment;

a finger extending from the second end of the base towards a bottom edge of the attachment, the finger extending parallel to the planar member;

the planar member is of a size, and the pin means and hook member are arranged on the second surface so that when the hook member is hooked to straps of a cap and the pin means is pinned to a dome of a cap, the attachment substantially covers an opening in a dome of a cap and the indicia means displays the trademark or logo.

9. An attachment for a cap comprising:

a planar member having a first surface, a second surface, a top area and an opposite bottom area;

indicia means on the first surface for displaying a trademark or logo;

at least one fastening means on the top area of the second surface for removably fastening the attachment to a fabric; and at least one hook member on the bottom area of the second surface for removably hooking the attachment to a cap, the hook member including a base having first and second ends, the base extending outwardly from the bottom area of the second surface of the attachment and interconnected at a first end with said attachment, and a finger extending from the second end of the base towards a bottom edge of the attachment, the finger extending parallel to the planar member, whereby, the at least one hook may engage the straps of a cap to attach the attachment to a cap, the indicia means displaying the trademark or logo.

10. An attachment for a cap comprising:

a planar member having a first surface, a second surface, a top area and an opposite bottom area;

indicia means on the first surface for displaying a trademark or logo;

at least one pin means on the top area of the second surface for removably pinning the attachment through a fabric; and at least one hook member on the bottom area of the second surface for removably hooking the attachment to a cap, the hook member including base extending outwardly from the bottom area of the second surface of the attachment and interconnected at a first end with said attachment, and a finger extending from the second end of the base towards a bottom edge of the attachment, the finger extending parallel to the planar member, whereby, the at least one hook may engage the straps of a cap to attach the attachment to a cap, the indicia means displaying the trademark or logo.

* * * * *